US009468794B2

(12) United States Patent
Barton

(10) Patent No.: US 9,468,794 B2
(45) Date of Patent: Oct. 18, 2016

(54) SYSTEM AND METHOD FOR SIMULATING ENVIRONMENTAL CONDITIONS ON AN EXERCISE BICYCLE

(75) Inventor: Stephen Barton, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 418 days.

(21) Appl. No.: 13/598,509

(22) Filed: Aug. 29, 2012

(65) Prior Publication Data

US 2013/0059698 A1 Mar. 7, 2013

Related U.S. Application Data

(60) Provisional application No. 61/530,298, filed on Sep. 1, 2011.

(51) Int. Cl.

| | |
|---|---|
| ***A63B 24/00*** | (2006.01) |
| ***A63B 21/22*** | (2006.01) |
| ***A63B 71/06*** | (2006.01) |
| ***A63B 21/005*** | (2006.01) |
| ***A63B 21/012*** | (2006.01) |
| ***A63B 22/06*** | (2006.01) |

(52) U.S. Cl.

CPC ..... *A63B 21/225* (2013.01); *A63B 21/0051* (2013.01); *A63B 21/0058* (2013.01); *A63B 21/012* (2013.01); *A63B 22/0605* (2013.01); *A63B 24/0087* (2013.01); *A63B 71/0622* (2013.01); *A63B 2024/009* (2013.01); *A63B 2024/0068* (2013.01); *A63B 2024/0071* (2013.01); *A63B 2024/0093* (2013.01); *A63B 2071/0641* (2013.01); *A63B 2071/0644* (2013.01); *A63B 2071/0655* (2013.01); *A63B 2071/0675* (2013.01); *A63B 2071/0683* (2013.01); *A63B 2220/36* (2013.01); *A63B 2220/803* (2013.01); *A63B 2220/833* (2013.01); *A63B 2225/20* (2013.01)

(58) Field of Classification Search

CPC ..... A63B 2225/00; A63B 71/0622; A63B 24/0075; A63B 22/02; A63B 22/0235; A63B 22/0023; A63B 24/00; A63B 24/0062; A63B 21/0059; A63B 21/4047; A63B 69/16

USPC ..... 482/57, 63, 8, 901, 900

See application file for complete search history.

(56) References Cited

U.S. PATENT DOCUMENTS

| | | | |
|---|---|---|---|
| 1,577,866 | A | 3/1926 | Mossberg |
| 3,686,776 | A | 8/1972 | Dahl |
| 3,903,613 | A | 9/1975 | Bisberg |

(Continued)

*Primary Examiner* — Glenn Richman

(74) *Attorney, Agent, or Firm* — Maschoff Brennan

(57) ABSTRACT

A stationary exercise cycle includes a simulation system for simulating real-world terrain based on environmental and other real-world conditions. Using topographical or other data, an actual location can be simulated. The exercise cycle may include a resistance mechanism that is adjusted based on changes in simulated slope, and by amounts simulating actual frictional and gravitational forces. The simulated speed of the rider, as well as speed and direction of a simulated wind, are used to determine a simulated air speed. Based on the simulated air speed, the simulation system determines the simulated air resistance hindering the rider, and changes reflective of the simulated air resistance are made by the resistance mechanism. The stationary exercise cycle takes into account actual or approximate physical information of the user in determining the real-world conditions that are simulated, including the height, weight, shape, and/or rising position of the rider.

19 Claims, 6 Drawing Sheets

(56) References Cited

U.S. PATENT DOCUMENTS

| | | | | | |
|---|---|---|---|---|---|
| 4,049,262 | A | | 9/1977 | Cunningham, Jr. | |
| 4,709,917 | A | * | 12/1987 | Yang | 482/63 |
| 4,711,447 | A | | 12/1987 | Mansfield | |
| 4,887,967 | A | | 12/1989 | Letovsky et al. | |
| 4,898,379 | A | * | 2/1990 | Shiba | 482/61 |
| 4,925,183 | A | | 5/1990 | Kim | |
| 4,932,651 | A | | 6/1990 | Defaux | |
| 4,938,475 | A | | 7/1990 | Sargeant et al. | |
| 5,240,417 | A | | 8/1993 | Smithson et al. | |
| 5,364,271 | A | | 11/1994 | Aknin et al. | |
| 5,435,798 | A | * | 7/1995 | Habing | A63B 21/4047 482/5 |
| 5,462,503 | A | | 10/1995 | Benjamin et al. | |
| 5,665,032 | A | | 9/1997 | Chen | |
| 5,785,630 | A | | 7/1998 | Bobick et al. | |
| 5,897,460 | A | | 4/1999 | McBride et al. | |
| 6,454,679 | B1 | | 9/2002 | Radow | |
| 7,303,510 | B2 | * | 12/2007 | Gebhardt | A63B 69/16 482/5 |
| 7,491,154 | B2 | | 2/2009 | Yonehana et al. | |
| 7,549,947 | B2 | | 6/2009 | Hickman et al. | |
| 7,648,446 | B2 | | 1/2010 | Chiles et al. | |
| 7,837,595 | B2 | | 11/2010 | Rice | |
| 7,841,964 | B2 | | 11/2010 | Radow | |
| 7,862,476 | B2 | | 1/2011 | Blau et al. | |
| 2011/0172059 | A1 | | 7/2011 | Watterson et al. | |
| 2013/0095978 | A1 | * | 4/2013 | Sauter | A63B 21/0059 482/4 |

* cited by examiner

SYSTEM AND METHOD FOR SIMULATING ENVIRONMENTAL CONDITIONS ON AN EXERCISE BICYCLE

RELATED U.S. APPLICATIONS

This application claims priority from U.S. provisional application No. 61/530,298 filed on Sep. 1, 2011.

TECHNICAL FIELD

The present disclosure relates generally to systems and methods for exercising. More particularly, the present disclosure relates to exercise cycle systems and methods for selective adjustment of resistance to simulate effects of wind on a cyclist and/or effects of real-world terrain on the cyclist.

BACKGROUND

While exercise equipment continues to be popular for casual and serious exercise enthusiasts who wish to exercise at home, in a gym, or in another indoor location, it remains a challenge to motivate a user to use the exercise device on a consistent and ongoing basis. This lack of motivation often is a result of the inability such devices have to realistically simulate real-world conditions. Users of exercise equipment often fail to enjoy a workout, or believe such a workout is insufficiently effective, because the equipment lacks the sort of realism of running, biking, or otherwise exercising on a real road or on other real-world terrain.

With respect to a typical stationary exercise cycle, for example, a user sits on a seat, holds onto a set of handles, and pedals with his or her feet. The user may vary the velocity of pedals, and thus the virtual velocity of the cycle, by increasing or decreasing the amount of effort the user uses to pedal or by increasing or decreasing the pedaling resistance provided by the exercise cycle. Merely riding a stationary exercise cycle and adjusting the pedaling rate and/or the pedaling resistance is, however, often insufficient to maintain a user's motivation to consistently use the stationary exercise cycle.

Devices that have been proposed to combat a lack of real-world feel to exercise cycles are found in U.S. Pat. No. 5,240,417, which describes simulating bicycle riding by using a stationary bicycle with a video display and an air blower. The display provides an animated image of a variable terrain track, and also visually reflects changes in speed and position based on pedaling, braking, and steering actions of the user. Sensors monitor the user's actions and transmit signals to a computer which adjusts the position of the bicycle on the video display. Forces of nature may also be simulated by, for example, applying power assistance for downhill coasting, or using an air blower to blow air at a user based on the user's velocity.

In addition, other exercise cycles or other devices include those in U.S. Pat. No. 1,577,866, U.S. Pat. No. 3,686,776, U.S. Pat. No. 3,903,613, U.S. Pat. No. 4,049,262, U.S. Pat. No. 4,709,917, U.S. Pat. No. 4,711,447, U.S. Pat. No. 4,887,967, U.S. Pat. No. 4,925,183, U.S. Pat. No. 4,932,651, U.S. Pat. No. 4,938,475, U.S. Pat. No. 5,364,271, U.S. Pat. No. 5,462,503, U.S. Pat. No. 5,785,630, U.S. Pat. No. 7,491,154, U.S. Pat. No. 7,549,947, U.S. Pat. No. 7,648,446, U.S. Pat. No. 7,837,595, and U.S. Pat. No. 7,862,476.

SUMMARY OF THE DISCLOSURE

In one aspect of the present disclosure, an exercise cycle includes a movable exercise element and a resistance mechanism configured to apply resistance to the movable exercise element.

According to one aspect of the present disclosure that may be combined with any one or more other aspects herein, an exercise apparatus includes a controller configured to simulate real-world conditions by controlling a resistance mechanism.

According to one aspect of the present disclosure that may be combined with any one or more other aspects herein, real-world conditions are simulated by simulating elevation changes.

According to one aspect of the present disclosure that may be combined with any one or more other aspects herein, real-world conditions are simulated by simulating environmental factors.

According to one aspect of the present disclosure that may be combined with any one or more other aspects herein, environmental factors that are simulated include wind.

According to one aspect of the present disclosure that may be combined with any one or more other aspects herein, personal characteristics of a user using an exercise apparatus is used to simulate real-world conditions.

According to one aspect of the present disclosure that may be combined with any one or more other aspects herein, height and/or weight information of a user are used to simulate real-world conditions.

According to one aspect of the present disclosure that may be combined with any one or more other aspects herein, one or more personal characteristics of the user are received as input at the exercise cycle.

According to one aspect of the present disclosure that may be combined with any one or more other aspects herein, one or more personal characteristics of the user are received from a remote source.

According to one aspect of the present disclosure that may be combined with any one or more other aspects herein, one or more personal characteristics of the user are received over the Internet.

According to one aspect of the present disclosure that may be combined with any one or more other aspects herein, a simulation system determines drag on a user based on a velocity of the exercise cycle and a wind velocity.

According to one aspect of the present disclosure that may be combined with any one or more other aspects herein, wind direction is used to determine drag on a user.

According to one aspect of the present disclosure that may be combined with any one or more other aspects herein, effects of wind are simulated where the wind has a direction not fully parallel to the direction of travel of the user.

According to one aspect of the present disclosure that may be combined with any one or more other aspects herein, changes to a resistance mechanism are made automatically based on changes to at least one of air resistance, frictional resistance, or gravitational forces.

According to one aspect of the present disclosure that may be combined with any one or more other aspects herein, a simulation of real-world air resistance includes determining or using any combination of a drag coefficient, air density, velocity, wind velocity, frontal area, or scaling factor.

According to one aspect of the present disclosure that may be combined with any one or more other aspects herein, a simulation of real-world frictional or gravitational forces includes determining or using any combination of one or more of velocity, slope, rolling friction coefficient, gravitational force, or mass.

According to one aspect of the present disclosure that may be combined with any one or more other aspects herein, a mass value includes any combination of one or more of a user's mass or weight, an actual exercise device mass or weight, or a simulated device mass or weight.

According to one aspect of the present disclosure that may be combined with any one or more other aspects herein, any one or more of a drag coefficient, rolling friction coefficient, gravitational force, frontal area, velocity, wind velocity, or slope are variable based on a user's personal characteristics and/or during a single workout.

According to one aspect of the present disclosure that may be combined with any one or more other aspects herein, air resistance is determined based at least in part on a current simulated altitude relative to an altitude of surrounding terrain being simulated.

According to one aspect of the present disclosure that may be combined with any one or more other aspects herein, a scaling factor is applied to determine air resistance being simulated.

According to one aspect of the present disclosure that may be combined with any one or more other aspects herein, a scaling factor is applied directly to wind velocity.

According to one aspect of the present disclosure that may be combined with any one or more other aspects herein, adjusting air resistance includes backing off the adjustment as a current altitude approaches a peak altitude.

According to one aspect of the present disclosure that may be combined with any one or more other aspects herein, wind velocity includes a speed and direction components.

According to one aspect of the present disclosure that may be combined with any one or more other aspects herein, only a portion of the speed component is used in determining air resistance when the wind direction is not parallel to a simulated direction of travel.

According to one aspect of the present disclosure that may be combined with any one or more other aspects herein, wind that is simulated is surface wind.

According to one aspect of the present disclosure that may be combined with any one or more other aspects herein, a movable element includes a pedal assembly.

According to one aspect of the present disclosure that may be combined with any one or more other aspects herein, a movable element includes a flywheel.

According to one aspect of the present disclosure that may be combined with any one or more other aspects herein, a resistance assembly applies a resistance directly or indirectly to a pedal assembly.

According to one aspect of the present disclosure that may be combined with any one or more other aspects herein, a resistance assembly applies resistance directly or indirectly to a flywheel.

According to one aspect of the present disclosure that may be combined with any one or more other aspects herein, a frontal area is calculated based at least on a user's individual height and/or weight.

According to one aspect of the present disclosure that may be combined with any one or more other aspects herein, an exercise bicycle includes a visual display.

According to one aspect of the present disclosure that may be combined with any one or more other aspects herein, a visual display provides still or video images corresponding to a simulated real-world location.

According to one aspect of the present disclosure that may be combined with any one or more other aspects herein, a visual display provides a visual depiction of a wind force being simulated.

According to one aspect of the present disclosure that may be combined with any one or more other aspects herein, a model is made of a relationship between power, rotational speed, and resistance of an exercise cycle.

According to one aspect of the present disclosure that may be combined with any one or more other aspects herein, a model is performed using a cubic or linear approximation.

According to one aspect of the present disclosure that may be combined with any one or more other aspects herein, power used in modeling resistance includes one or more of an input power, output power, or power loss.

According to one aspect of the present disclosure that may be combined with any one or more other aspects herein, air resistance is determined as power lost due to air resistance.

According to one aspect of the present disclosure that may be combined with any one or more other aspects herein, frictional effects is determined as power lost due to rolling friction.

According to one aspect of the present disclosure that may be combined with any one or more other aspects herein, gravitational effects are determined as power lost due to gravity.

According to one aspect of the present disclosure that may be combined with any one or more other aspects herein, power lost due to air resistance is determined using the equation: $(1/2)(VC_dA\rho)(V+V_{wind})^2$.

According to one aspect of the present disclosure that may be combined with any one or more other aspects herein, the equation $(1/2)(VC_dA\rho)(V+V_{wind})^2$ is modified by a scaling factor.

According to one aspect of the present disclosure, the value of $V_{wind}$ is modified by a scaling factor.

According to one aspect of the present disclosure that may be combined with any one or more other aspects herein, power lost due to frictional and gravitational elements is determined using the equation: $mgV(C_{rf}+\text{slope})$.

According to one aspect of the present disclosure that may be combined with any one or more other aspects herein, adjusting a resistance to simulate wind, weather or other environmental conditions includes adjusting the same resistance mechanism used to simulate rolling friction and/or difficulty due to an incline.

BRIEF DESCRIPTION OF THE DRAWINGS

The accompanying drawings illustrate various embodiments of the present systems and methods and are a part of the specification. The illustrated embodiments are merely examples of the present systems and methods and do not limit the scope thereof. Throughout the drawings, identical reference numbers designate similar, but not necessarily identical, elements.

DETAILED DESCRIPTION

A stationary exercise cycle including an environmental simulation system is disclosed herein. Specifically, embodiments of the present disclosure provide an exercise cycle the ability to simulate any of a number of different environmental conditions, including wind conditions. The simulation system may identify a wind speed and/or direction. Based on such wind conditions and the speed of the rider, air resistance may be determined. According to one embodiment, the determined air resistance may be transformed into a value that is correlated with a resistance setting of the exercise cycle. Changes in the wind speed, velocity of the rider, or the direction of the wind or route of the rider may cause changes in the air resistance and thus the resistance applied by the exercise cycle. In some embodiments, frictional and/or gravitational components (e.g., road type, rain, slope, etc.) may be considered for application by the resistance mechanism of the exercise cycle to simulate a real-world resistance. Any combination of frictional, gravitational and/or air resistance elements may be combined and applied by the resistance mechanism to simulate real-world conditions.

Figure 1:
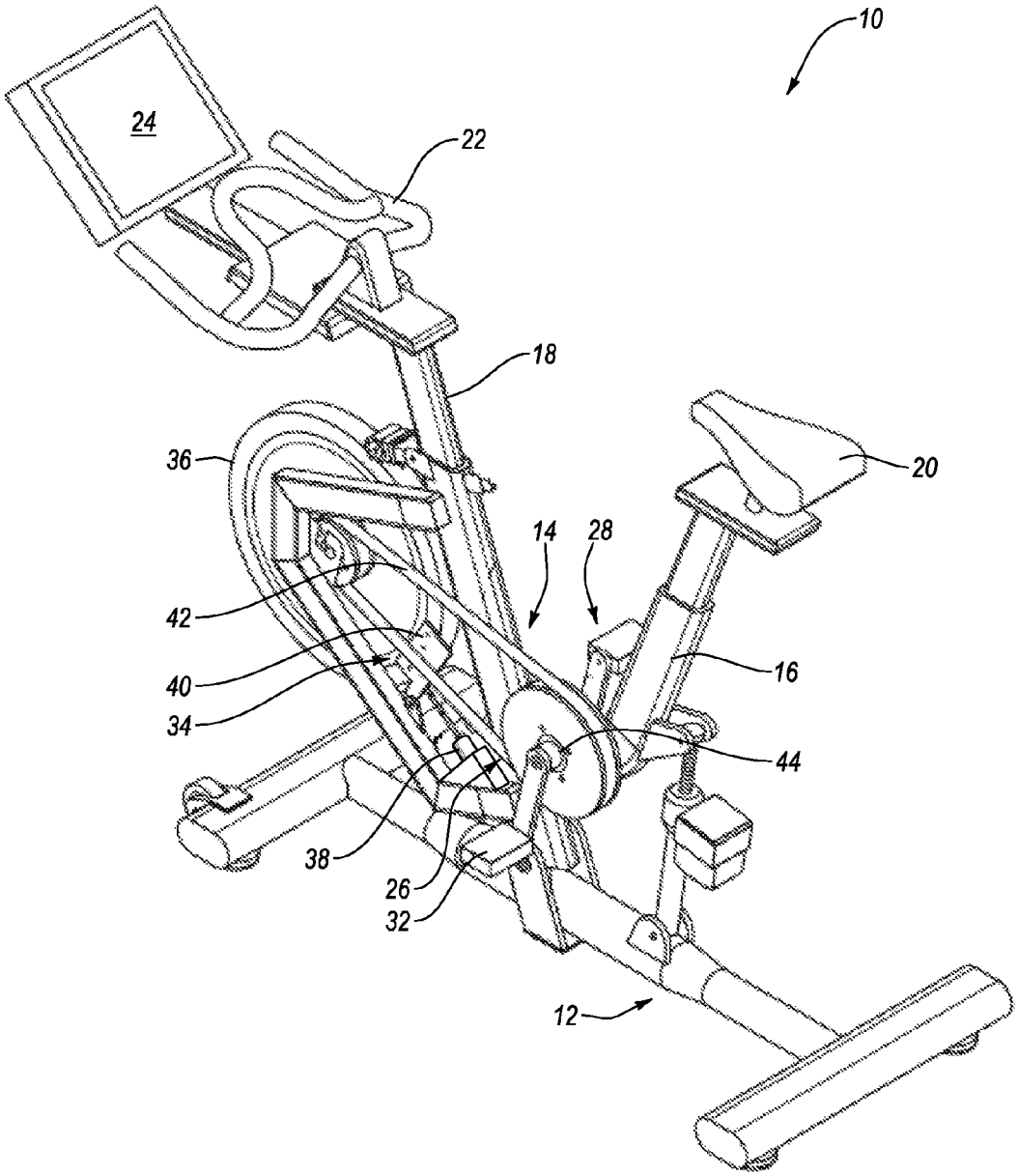
FIG. 1 is a perspective view of an example exercise cycle according to one embodiment of the present disclosure.

In FIG. 1, an illustrative exercise system 10 is depicted in the form of an exercise cycle. In the illustrated embodiment, the exercise system 10 includes a support base 12 and a generally upright support structure 14 connected thereto. Upright support structure 14, in this illustrative embodiment, includes two support members 16, 18, and may be referred to as a bicycle frame, although it need not look or act like a bicycle frame of a road, mountain, or other real-world cycle. Support member 16 of the illustrated embodiment includes a seat 20 upon which a user may sit when exercising using exercise system 10. Support member 18 includes, in this embodiment, a handlebar assembly 22 and a control panel 24.

In the illustrated embodiment, a drive assembly 26 is mounted on upright support structure 14, although the drive assembly 26 may be mounted in any other suitable location. Drive assembly 26 includes a movable exercise element in the form of a rotatable pedal assembly 28. Pedal assembly 28 specifically includes, in this embodiment, a pair of cranks 30 that are rotatably mounted on, or otherwise located relative to, support member 16 and/or support base 12. Attached to each crank 30 is a pedal 32. A user can engage each pedal 32 with a respective foot and exert a force used to rotate pedal assembly 28.

Drive assembly 26 also includes, in this embodiment, a resistance system 34 for varying the force required from the user to rotate pedal assembly 28. Resistance system 34 may include an assembly or mechanism that includes a movable exercise element such as flywheel 36, which is in this embodiment mounted on or relative to support member 16. An electric motor 38 may also be included in resistance system 34. Electric motor 38 may, for instance, connect to a brake element 40 proximate flywheel 36. Brake element 40 may include a frictional brake, magnetic brake, eddy brake, or other mechanical, electromechanical, or other mechanism suitable for controlling or applying resistance to rotation of the pedal assembly 28 and/or the rotational speed of flywheel 36. More particularly, in the illustrated embodiment, resistance system 34 includes an endless belt or chain 42 extending between pedal assembly 28 and flywheel 36. A user may rotate pedal assembly 28 which, by utilization of endless belt or chain 42, causes flywheel 36 to rotate. In similar fashion, when brake element 40 applies resistance to rotation of flywheel 36, the resistance is transferred to pedal assembly 28. Consequently, if a constant force is applied at pedal assembly 28, the rotational speed of flywheel 36 may be varied based on the resistance applied by resistance system 34. Stated another way, if the resistance applied by resistance system 34 is varied, a user must exert a variable force at pedal assembly 28 in order to maintain flywheel 36 at a constant rotational speed.

Although the brake element 40 is illustrated as acting upon the flywheel 36, it should be appreciated that such a configuration is merely exemplary. For instance, in other embodiments, electric motor 38 of resistance system 34 may apply or adjust a resistance independent of, or in addition to, brake element 40. By way of illustration, electric motor 38 may selectively actuated to apply a current that operates similar to a magnetic brake. The electric motor 38 may be directly or indirectly connected to a crankshaft 44 extending between cranks 30, and the applied current may apply resistance at crankshaft 44 rather than, or in addition to, resistance applied by brake element 40. Based on the amount of current or resistance provided, the degree to which rotation of the crankshaft 44 is hindered may vary.

Resistance system 34, including electric motor 38, may be controlled in any suitable manner. For instance, in one embodiment, the resistance system 34 and/or electric motor 38 are controlled using a controller (see FIG. 4) that may act alone, or in concert with other components (e.g., a communication interface, network adapter, bus, input system, etc.) as a simulation system as described herein. A suitable controller may be incorporated within resistance system 34, control panel 24, or even in a remote or separate computing system communicatively linked to exercise system 10.

Figure 2:
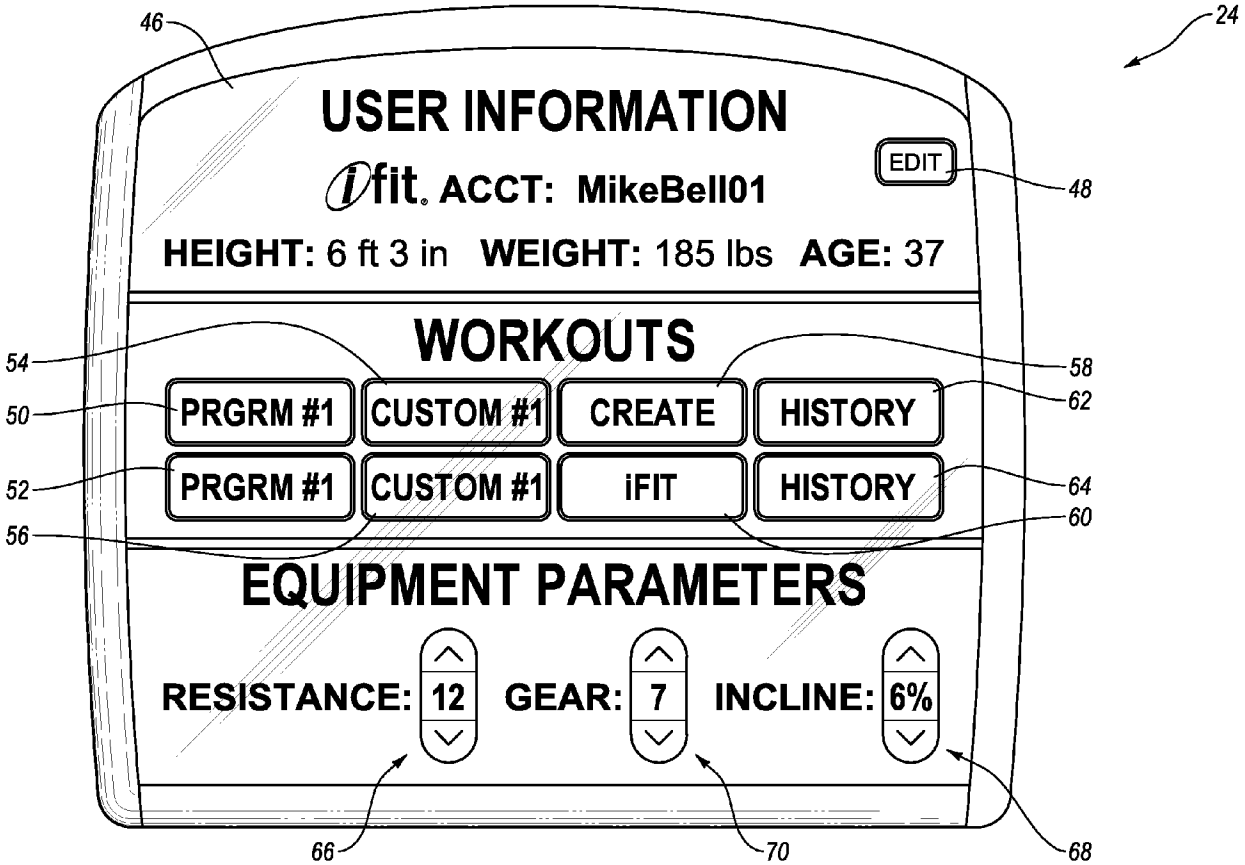
FIG. 2 illustrates an exemplary control panel of an exercise cycle according to one embodiment of the present disclosure, the control panel providing input and output capabilities.
Figure 3:
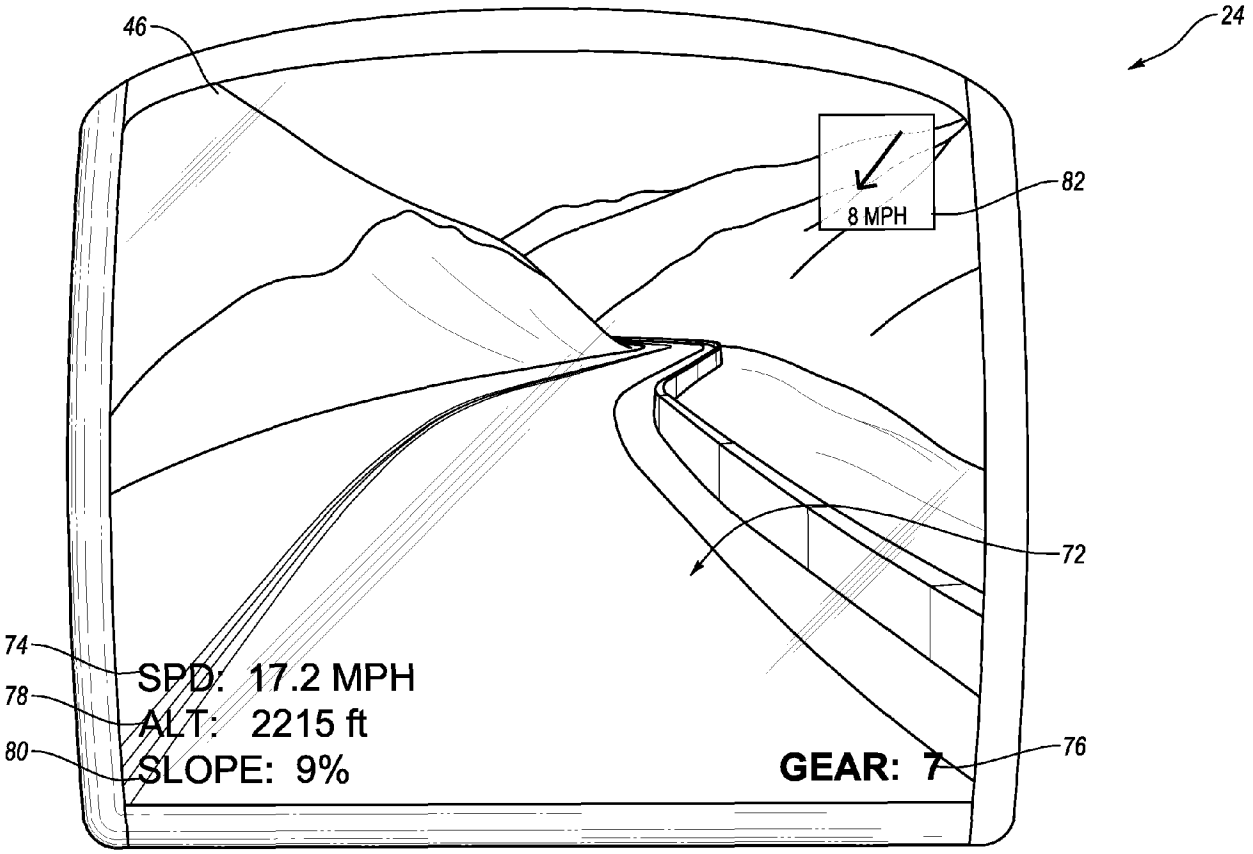
FIG. 3 illustrates an exemplary control panel of an exercise cycle according to another embodiment of the present disclosure, the control panel including a display depicting terrain and/or environmental conditions simulated by the exercise cycle.

As shown in FIG. 1, exercise system 10 includes a control panel 24 attached to handlebar assembly 22 and/or upright support structure 14. FIGS. 2 and 3 illustrate examples of control panel 24 in greater detail. In particular, control panel 24 can include one or more interface devices. Such interface devices may include input devices and/or output devices. Input devices generally enable a user to input and vary the operating parameters or other information of the exercise system 10, while output devices provide information to the user. As an example of an input device, control panel 24 may include a touch-sensitive display 46. Touch-sensitive display 46 may itself provide one or more input controls. In FIG. 2, for instance, touch-sensitive display 46 includes a control 48 for editing personal information. According to one embodiment, personal information may include information about the user such as, but not limited to, the user's height, weight, and age. Additional information may include the user's fitness level, exercise history, preferences (e.g., workout preferences, display settings, etc.), or other information. Such personal information may be stored by exercise system 10 or stored remotely in a database or other storage location accessible to exercise system 10. In some embodiments, personal information may be input remotely and retrieved or edited locally at exercise system 10. Accordingly, in some embodiments of the present disclosure, exercise system 10 may also include an authentication system for uniquely identifying the user, thereby allowing access or use of information stored locally and/or for remotely. In FIG. 2, for instance, the exercise system may have authenticated a user associated with the iFIT account for "MikeBell01."

Other controls available at control panel 24 may include controls 50-56 for running a preprogrammed or custom workout, control 58 for creating a new workout, control 60 for accessing IFIT.COM workouts (e.g., through the Internet), control 62 for accessing a workout history, and control 64 for accessing real-world maps and/or creating a workout based on real-world maps. An example system for creating workouts based on real-world maps is described in additional detail in U.S. Patent Publication No. 2011/0172059, entitled "SYSTEM AND METHOD FOR EXERCISING" and filed on Mar. 10, 2011 which application is expressly incorporated herein by this reference in its entirety.

One skilled in the art will appreciate in view of the disclosure herein that additional and other controls related to workouts or exercise programs may also be included. For instance, exemplary controls may allow a user to initiate a workout or pause or stop a workout in progress. Still other input controls may include controls for adding, deleting or editing workouts stored in a history, controls for changing the display (e.g., between street, map, and satellite views), controls for accessing music, video, or other files, etc. Also illustrated in FIG. 2 are controls to vary the equipment parameters during an active workout. Control 66 may allow a user to, for instance, select a particular resistance level on exercise system 10. Control 68 may allow a user to select an incline which the exercise system 10 may simulate (e.g., through tilting the equipment or adjusting resistance as applicable). In some cases, the exercise system 10 may simulate an exercise bicycle with multiple gears, in which case a control 70 may be provided to allow a user to change gears. Such a gear change may cause physical gear changes in exercise system 10 or the gear change may be modeled and simulated as virtual gear changes.

In accordance with one embodiment of the present disclosure, a workout or other exercise program may be performed using exercise system 10 in a manner that simulates or otherwise relates to real-world conditions. FIG. 3 illustrates an example of control panel 24 during execution of such a workout. In particular, display 46 may provide a graphical depiction 72 of terrain being traversed by the user exercising with the aid of exercise system 10. The depiction 72 may include satellite views, map views, street views, or other views. In one embodiment, such views include pictures and/or videos of real-world places. In other embodiments, such views include illustrations, renderings, or animations of real-world places. In still other embodiments, the views may be illustrations, renderings, animations or other depictions of fictitious or virtual locations.

Real-world information may be obtained by linking into databases that provide such information. For instance, MAPQUEST.COM, MAPS.GOOGLE.COM, and GOOGLE EARTH are all examples of databases available over the Internet which provide map-related information. Such information may be accessed for use with a stored program, a program created by the user, or even an on-the-fly exercise routine. The change or play rate for image data may vary based on the user's speed as determined on the exercise system 10. During a workout simulating real-world locations, topographical information may also be accessed (e.g., from the GTOPO30 maintained by the U.S. Geological Survey). Topographical information may be used to generate or display images generally depicting the user climbing or descending a hill. Such topographical information may also be used to more accurately simulate real-world conditions, such as by adjusting resistance levels based on slope, or determining the effect of surrounding geographical features on wind.

As also shown in FIG. 3, display 46 may provide additional information in lieu of, or in addition to, graphical depiction 72. In particular, in the illustrated embodiment, controls 74, 76 provide information about the operating parameters of the exercise system 10. More particularly, control 74 displays the speed of the user, while control 76 displays the gear—whether it be physical or virtual—the user is in. Controls 74, 76 may be output controls, although in other embodiments they may also be enabled to act as inputs. For instance, a user may change gears by selecting control 76. Controls 78, 80 provide additional information related to the terrain being virtually traversed. Such information may be obtained from topographical databases or stored within a program accessible to the exercise system, and can display information related to the current altitude and/or slope. Other controls may provide still other information, or provide the user with input options. Optional elements that may be displayed on the control panel 24 of FIG. 3 may also include start, stop, or pause controls, a distance control providing the distance travelled and/or remaining in the program, a calorie control indicating the approximate number of calories burned, an indication of the type of terrain being traversed (e.g., dirt, pavement, sand, etc.), and the like.

An additional control illustrated in FIG. 3 is a wind control 82. As will be appreciated, a user exercising outdoors will encounter elements such as rain, wind, and the like. In one embodiment of the present disclosure, either or both of surface wind and wind generated by a user's movement may be taken into account when providing an exercise routine simulating real-world conditions. Indeed, when exercising in the real-world terrain, any of the real-world conditions reflected by controls 78-82 can affect the amount of effort that must be expended by a rider of a bicycle or other exercise device, and thus may be simulated in some embodiments of the present disclosure. For instance, the wind is illustrated as moving at approximately eight miles per hour, and in a direction that has both headwind and crosswind components (i.e., in a direction not directly parallel to the direction the user is virtually moving). In an outdoor setting, such a wind would create air resistance in the form of drag, and hinder the cyclist's movement. The altitude and slope may have similar effects. For instance, the gravitational and/or frictional resistance felt by a cyclist on a real-world course will vary based on the slope, and whether the terrain is uphill, flat, or downhill, or on what type of roadway or path is being simulated. The altitude can also affect the resistance felt by a cyclist. More particularly, at lower elevations the air has a higher density than air at higher elevations. The more dense air thus increases the air resistance at such elevations. While the illustrated wind control 82 is shown as showing a single wind value, it should be appreciated that the control 82 may also show other weather values. In still other embodiments, the wind control 82 may be a wind map showing wind values at multiple locations.

Figure 4:
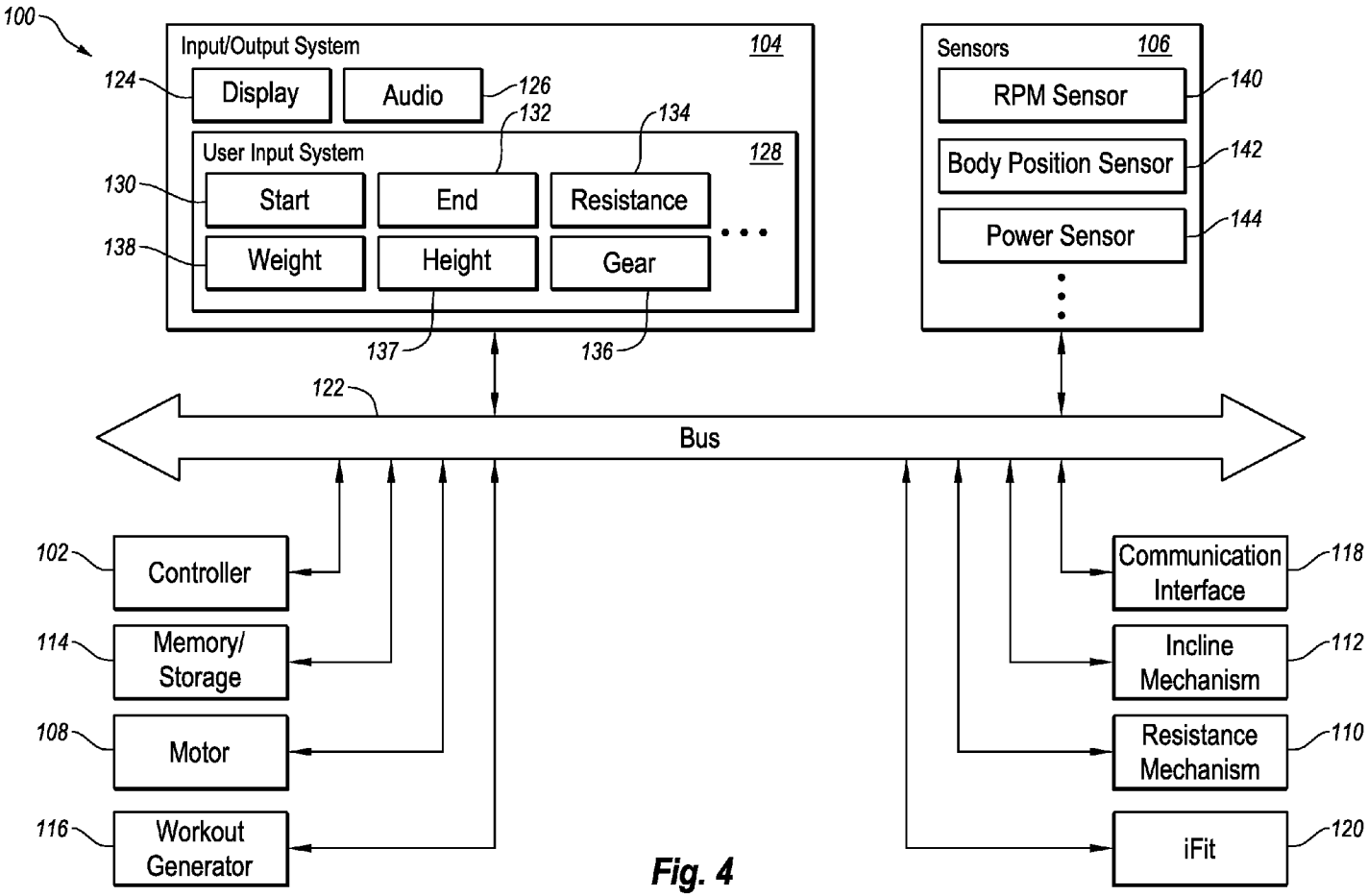
FIG. 4 schematically illustrates an exercise cycle according to another embodiment of the present disclosure.

An exemplary system for simulating the effects of such components is schematically illustrated in FIG. 4, in the form of exercise system 100. Exercise system 100 generally includes a variety of components that cooperate to allow a user to exercise while also simulating real-world conditions or terrain. In the illustrated embodiment, for instance, a controller 102 is illustrated as being in communication with an input/output system 104, sensor system 106, a motor 108, resistance mechanism 110, incline mechanism 112, and various other components 114-120 using a communication bus 122.

Controller 102 may include one or more processor or other components that, either alone or in combination with one or more other components, can be used to simulate real-world resistance such as air resistance, rolling friction, and gravity-related resistance. Accordingly, in some embodiments, Controller 102 may act as a simulation system and/or as a means for means for adjusting the resistance assembly by simulating real-world friction, including air resistance that is based on particular personal characteristics of the rider, a simulated velocity, and a simulated surface wind. In some embodiments, the means for adjusting the resistance assembly may include other components, including any combination of controller 102, input/output system 104, sensors 106, motor 108, resistance mechanism 110, incline mechanism 112, memory/storage component 114, workout generator 116, and communication interface 118. In still other embodiments, the means for adjusting the resistance assembly many include components (e.g., controller 102, memory/storage component 114) programmed with particular algorithms, tables, and the like that are used to determine simulated real-world resistance values.

As discussed herein, a workout intended to simulate real-world terrain may include still and/or video images, and potentially audio. Such information can be retrieved or processed by controller 102 and conveyed to input/output system 104, where it may be provided to the user via display 124 and/or audio output 126. Inputs received at a user input system 128 of the input/output system 104 may affect the resistance being simulated by the exercise system 100. For instance, a user may change operation parameters of the system 100 using user input system 128, which may then pass the information to controller 102. An example start control 130 may be used to start an exercise program and an end control 132 used to terminate a program or workout. During the exercise routine, the user may manually or otherwise adjust the resistance using the resistance control 134. The gear selected by the user using gear control 136 can also affect at least the simulated speed of the user, and potentially the resistance felt by the user. Additional controls to receive or display a user's height (control 137) and weight (control 138) can also be used. In a real-world environment, the user's weight can have a direct effect on the frictional and/or gravitational resistance to a cyclist's movement. Further, as described with respect to FIG. 6, the shape of the user can have a potentially large impact on the air resistance felt by the user. Consequently, the weight and/or height of the user can be used to approximate an area or other shape factor for calculating air resistance.

In that regard, various sensors in the exercise system 100 may also be used to facilitate a determination of the resistance to apply to simulate real-world environmental conditions. For instance, the sensor system 106 may include an RPM sensor 140, body position sensor 142, power sensor 144, or any number of other sensors. The illustrated sensors may have a variety of purposes. RPM sensor 140 may determine the rotational speed of a flywheel, crankshaft, or other component of the exercise system 100. Controller 102 may use the rotational speed to calculate a velocity of the user, which velocity may also be affected by the gear. RPM sensor 140 may take any suitable form or construction. For instance, in one embodiment, RPM sensor 140 is a magnetic sensor. In other embodiments, RPM sensor 140 is a brushless motor sensor, telemetry sensor, or other sensor.

The position of a user's body can potentially affect the air resistance felt by a user. By way of illustration, exercise system 100 may include handlebars (see FIG. 1) tht a user can grasp in different manners. In a highly aerodynamic position, a user may be hunched over the handlebars while holding drops of the handlebars, and can have a reduced frontal area and a tapered back profile, both of which serve to reduce drag. In contrast, a user sitting in an upright position while holding the hoods of handlebars can have an increased frontal area and more blunt back profile, both of which increase drag. Accordingly, in some embodiments, body position sensor 142 may determine an approximate body position of the user. An exemplary body position sensor may include a 3D scanner or other visualization sensor that can be analyzed by controller 102 or within sensor 142. Other body position sensors may include pressure sensors to determine the weight distribution relative to a frame of the exercise system 100, or may be integrated into handlebars. Sensors within handlebars may be used to determine what portion of the handlebars are being gripped so as to determine the approximate riding position of the user. Regardless of the type of sensor or other component used as body position sensor 142, controller 102 may use the information in simulating real-world conditions, such as by adjusting the resistance mechanism 110.

Power sensor 144 may be used to determine the power output at a particular component of exercise system 100. In one embodiment, for instance, power sensor 144 may include a torque meter that determines the torque at one or more rotating components (e.g., crankshaft, flywheel, etc) of the exercise system 100. Controller 102 may use such information to determine the input power from a user, the power output after losses through the system, or other characteristics useful for simulating real-world environmental conditions.

Based on information controller 102 receives through bus 122 from input/output system 104 and/or sensor system 106, controller 102 may communicate with motor 108, resistance mechanism 110, and/or incline mechanism 112. In one example embodiment, controller 102 may send information through communication bus 122 to resistance mechanism 110 to simulate air resistance calculated as a drag force or power lost due to drag. In some embodiments, information may be passed to motor 108 which may control resistance mechanism 110. In the same or other embodiments, as slope or road conditions of simulated terrain change, controller 102 may communicate information to motor 108, resistance mechanism 110, and/or incline mechanism 112 to cause changes to resistance or the position of a frame element.

Exercise system 100 may also include a memory/storage component 114, a workout generator 116, a communication interface 118, an IFIT component 120, or any number of other components. Memory/storage component 114 may have any number of purposes and can store any number of components. For instance, memory/storage component 114 may store pre-programmed or custom workouts, a workout history, gear tables, power/resistance conversion tables, still or video images, audio information, and the like. Workout generator 116 may generally be used to create workouts. In some embodiments, workout generator 116 may allow a user to input parameters (e.g., resistance, incline, altitude, slope, distances, etc.) to create a workout. In other embodiments, workout generator 116 may be at least partially automated. For instance, workout generator 116 may access real-world map or other data. A user may select start/end points and/or route information, and workout generator 116 may use geographic information to determine and specify the altitude, slope, resistance, etc. to be simulated.

A communication interface 118 may also be provided. According to one example embodiment, communication interface 118 may allow controller 102 to communicate with remote or local components or data sources. By way of illustration, real-world terrain and/or map information may be stored in a remote data store, and communication interface 118 may connect to the Internet or use another communication system to access the data store and the information. In still another embodiment, controller 102, input/output system 104, memory/storage 114, workout generator 116 or the like may be located remote from portions of the exercise system 100 or may be distributed among multiple components in different locations. Communication interface 118 may allow the distributed or remote components to communicate and cooperatively operate exercise system 100.

IFIT component 120 may also operate in connection with communication interface 118 in some embodiments. In general, IFIT component 120 may provide exercise system 100 with access to the IFIT.COM website and/or database. The IFIT.COM service may provide workouts, workout creation tools, or other information, including user specific information. As needed, or upon request, controller 102 may access desired information. For instance, the user's height, weight, age, workout history, or other information may be stored in the IFIT.COM database. Such information may be retrieved when needed, such as when height and/or weight information is used to determine air resistance during a workout. Alternatively, other information such as workouts may be stored at the IFIT.COM or other similar website, and retrieved using the IFIT component 120 and/or communication interface 118.

Figure 5:
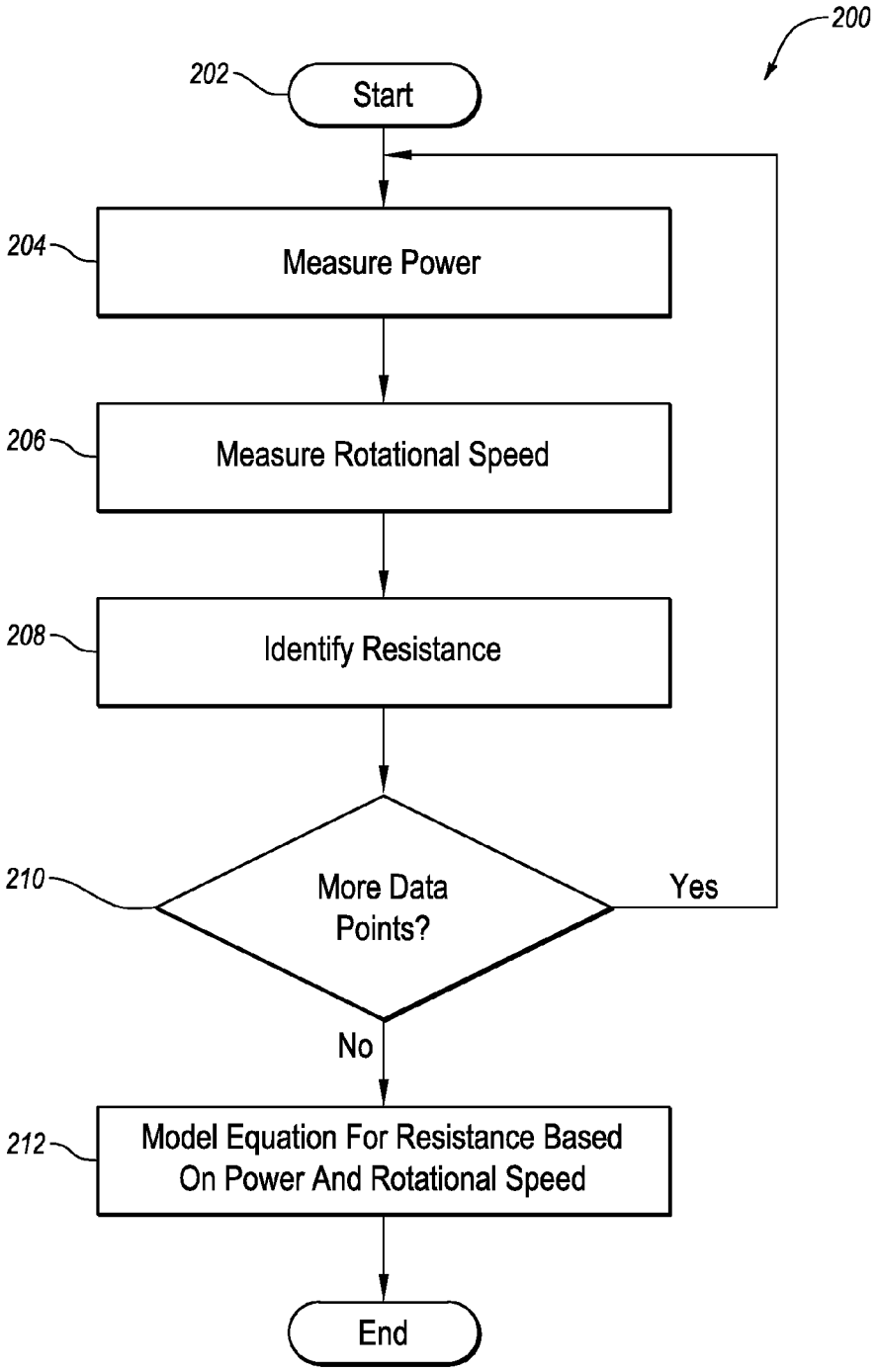
FIG. 5 is a functional block diagram of an example process of modeling resistance of an exercise device relative to rotational speed and power.
Figure 6:
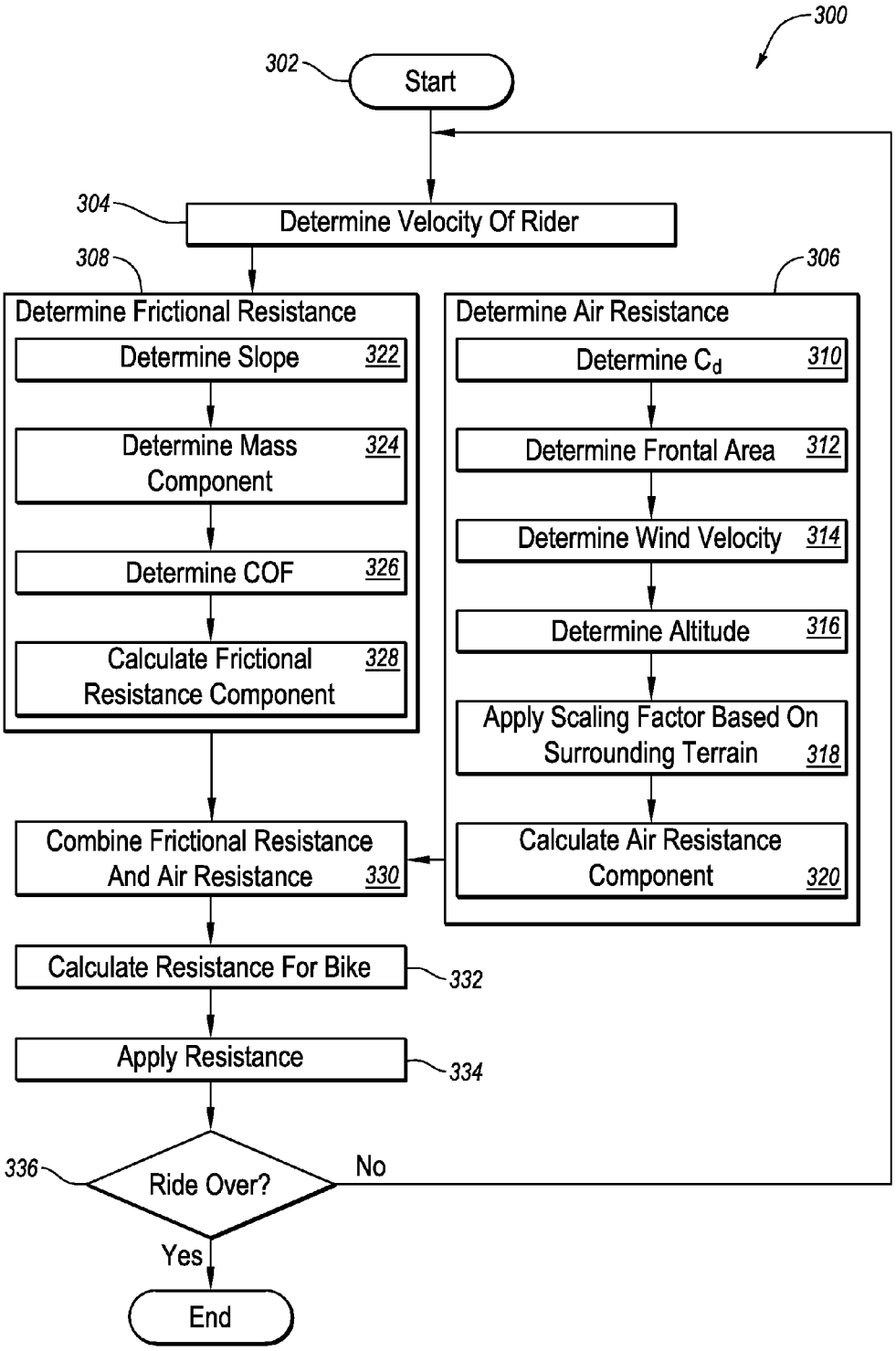
FIG. 6 is a functional block diagram of an example process of simulating environmental conditions on a stationary exercise cycle, according to one embodiment of the present disclosure.

FIGS. 5 and 6 illustrate example flow charts for use in simulating environmental conditions during an exercise program. To illustrate example methods in accordance with the present disclosure, FIGS. 5 and 6 may be described with reference to components illustrated in FIGS. 1-4.

FIG. 5 generally illustrates an example process 200 of modeling resistance of an exercise cycle. More particularly, in the illustrated embodiment resistance is modeled relative to rotational speed and power generated, although resistance may be modeled in other manners. In particular, method 200 begins 202 and a power measurement is obtained in act 204. The power measurement may be obtained by a suitable power sensor built into the exercise device or independent therefrom. In one embodiment, a power sensor such as power sensor 144 of FIG. 4 is used. As noted previously, power sensor 144 optionally includes a torque meter, and can obtain a reading in a power unit such as Watts, although other units may be used. For instance, a power sensor may measure torque in Newton meters, or in another similar unit of torque, which unit can be combined with a rotational speed and be converted to a power unit. The power may be measured at one or more locations in an exercise system. For instance, relative to the exercise system 10 of FIG. 1, power may be measured at flywheel 36, crankshaft 44, in other locations, or in any combination of the foregoing. In some embodiments, obtaining a power measurement (act 204) may include obtaining a power differential. By way of illustration, power measured at crankshaft 44 and power measured at flywheel 36 may vary due to frictional, resistive, or other forces. The difference of the power measurements may be a power loss value.

In some embodiments of the present disclosure, a process 200 for modeling resistance may include an act 206 in which rotational speed (or angular velocity) is measured. Similar to the measurement of power, rotational speed may be measured at any suitable location, including a flywheel, crankshaft, or other location. Rotational speed may be measured using a suitable sensor that is built-in or independent of a particular exercise device, or may be otherwise calculated. One such sensor may include RPM sensor 140 of FIG. 4.

The exercise system used to obtain power and rotational speed measurements may also include a resistance mechanism (see FIGS. 1 and 4). The resistance mechanism has multiple resistance settings. In one embodiment, power and rotational speed measurements are obtained in acts 204 and 206 while the resistance mechanism has a particular resistance setting that is identified in act 208. As a result, a variety of sets of associated data points, each set including power, rotational speed, and resistance, can be generated. Often, more than a single data set may be needed. Thus, as data is collected, a determination can be made whether more data points are desired or needed (act 210). If determined in the affirmative, the process 200 may become iterative by, for instance, returning to act 202 for obtaining a new set of power, rotational speed, and resistance values.

When sufficient data points have been obtained, process 200 may move to act 212. In act 212, the sets of data points are used to model an equation for resistance based on power and rotational speed. For instance, as there are three degrees of freedom, a three-dimensional equation may be modeled. One mechanism for doing so may include fitting the data points to a cubic equation using a full logarithmic fit. In an example exercise system, such a fit was found to produce an equation fitting to 99.9% accuracy. Equations may, however, be modeled in other manners, including to linear equations using linear regression, or by using other techniques. As noted above, the power value used for the model may include a power input, power output, or a difference in power (e.g., power loss).

Modeling resistance as dependent on power and rotational speed is one mechanism for allowing an exercise system to simulate the effects of air resistance and other environmental conditions on an exercise cycle. One example logarithmic formula found to be useful is:

$$R=224.44-169.85\ \ln(\omega)+90.05\ \ln(P)+55.14\ \ln(\omega)^2+9.49\ \ln(P)^2-13.70\ \ln(\omega)^3+4.93\ \ln(P)^3-49.50\ \ln(\omega)\ln(P)+26.25\ \ln(\omega)^2\ \ln(P)-18.62\ \ln(P)^2\ \ln(\omega)$$

In the above formula, R is the resistance level for the exercise device (e.g., a motor position for adjusting a magnetic resistance mechanism), while co represents the measured rotational speed (e.g., in revolutions per minute) and P represents the measured power value (e.g., in Watts).

As will be appreciated in view of the disclosure herein, the particular equation that is modeled or which is otherwise obtained may vary based on a number of factors. For instance, depending on the motor, resistance mechanism, parts, size of components, and the like, each device may reflect a different relationship between resistance, rotational speed, and power. In the example of an exercise cycle having a magnetic resistance mechanism in which the position of one or more magnets changes to modify resistance (e.g., closer to the wheel the more resistance), the position, size or type of motor, the position, strength or size of magnets, the smoothness of surfaces, among other factors, may significantly affect the relationship between power, rotational speed, and resistance settings. Thus, a single equation modeling resistance in terms of power and rotational speed may not be ideal all equipment. In another example embodiment, an equation for modeling resistance relative to power and rotational speed may be:

$$R=-632.45+0.17\omega+\frac{86.90}{P^2}$$

The manner in which rotational speed and power can be used to determine a resistance setting simulating certain environmental conditions may be better understood in the context of the various types of resistance in real-world conditions. As noted previously, movement of a bicycle along real-world terrain subjects the bicycle to environmental conditions that are often not present in a stationary and/or indoor setting. In particular, environmental conditions can be seen as creating at least three real-world elements that do not naturally affect a stationary bicycle in the same way that a non-stationary bicycle is affected. These include air resistance or drag, rolling resistance, and gravity.

With regard to air resistance, as a bicyclist moves along real-world terrain, the rider moves through the surrounding air. The surrounding air has a mass and density, and the flow of air past and around the rider creates a frictional, drag force that acts in a direction opposite the motion of the cyclist. On a stationary cycle, the cyclist does not have the corresponding air flow and drag force. Generally speaking, air flow around a moving object can occur at a velocity that is about the same as the moving object. In many cases, however, there may other factors, including weather related elements such as wind. For instance, a cyclist may be riding directly into a headwind. In such case, air tends to flow around the rider, from front to back, at a velocity that is about the sum of the wind velocity and the rider's velocity. In an opposing scenario, a rider may be riding with a tailwind. If the velocity of the rider is greater than the velocity of the tailwind, air may move around the rider, from front to back, at a velocity about equal to the rider's velocity less the wind velocity. If the velocity of the rider is less than the velocity of the tailwind, air may move around the rider, from back to front, at a velocity about equal to the wind velocity less the rider's velocity.

One aspect of the present disclosure is to simulate the effect air resistance has on the effort a rider must extend to overcome air resistance forces by adding resistance to a resistance mechanism, despite the stationary rider not directly experiencing air resistance. In general, the forces may be simulated by causing the resistance mechanism to be adjusted by an amount generally corresponding to the expected air resistance. Air resistance may be calculated in a number of different manners, and two manners may include determining the drag force or the power loss due to air resistance.

The drag force is the equivalent force of the air resistance and acts in a direction opposite the direction of movement of the cyclist relative to the surrounding air. It may generally be calculated using the equation:

$$F_d = C_d A\left(\frac{\tilde{n}}{2}\right)(V + V_{wind})^2$$

In the above equation, $F_d$ is the drag force, $C_d$ is the drag coefficient, A is the frontal reference area of the moving object, ρ is the density of air, V is the velocity of the object relative to air, and $V_{wind}$ is the velocity of a wind, where a headwind is a positive value and a tailwind is a negative value. Inasmuch as power is equal to a force times velocity, the power loss ($P_d$) due to air resistance may be calculated using the equation:

$$P_d = VC_d A\left(\frac{\tilde{n}}{2}\right)(V + V_{wind})^2$$

In each of the above equations, the representative force or power component is at least in part based on the frontal area of the moving object, as well as on the drag coefficient. The drag coefficient is a dimensionless number that generally quantifies the drag or resistance of an object, and varies based on the shape of the object. Drag coefficients are often measured values and can range from about 0.001 for highly aerodynamic shapes to values over 2.0 for less aerodynamic shapes. For a cyclist, a measured drag coefficient may based on factors such as the physical, personal characteristics (e.g., height, weight, etc.) and shape of the rider, as well as the riding position (e.g., upright while holding the hoods or more aerodynamic while holding the drops) of the rider.

As will be appreciated in view of disclosure herein, the frontal area for a cyclist may also vary based on a variety of factors. For instance, a taller and heavier rider will likely have a larger frontal area than a smaller and lighter person. The frontal area can also vary based on the position of the rider, where an upright position exposes a larger frontal area than a more hunched over, aerodynamic position. While a simulation system may use a fixed drag coefficient or frontal area, such values may also be dynamic to more accurately estimate the effects of air resistance.

As also noted above, other environmental factors that may affect a moving object in a real-world environment include rolling resistance and gravity. Rolling resistance is the resistance that results from a round object—such as a tire—rolling on a surface. The effort a rider must expend to overcome gravity also increases as the steepness of a slope increases. Both rolling resistance and gravitational effects vary proportionally with the weight of a moving object. In particular, in accordance with the present disclosure, the resistance forces due to rolling friction and gravity may be approximated using the equation:

$$F_f = mg(C_{rf} + \text{slope})$$

In this equation, $F_f$ is the combined forces of friction due to rolling and gravity, m is the mass of the moving object (i.e., the cycle and rider), g is the force of gravity, $C_{rf}$ is the coefficient of rolling friction, and slope is the road slope. Both the coefficient of friction and slope are dimensionless values as slope may be determined by elevation change over distance. Using the velocity of the object (V), the power loss ($P_f$) due to the combined forces of rolling friction and gravity may be approximated using the equation:

$$P_f = mgV(C_{rf} + \text{slope})$$

In each of the above equations, the representative force or power component is at least in part based on the coefficient of rolling friction. The coefficient of rolling friction is a dimensionless number that generally quantifies the frictional forces acting between two bodies in which one rolls relative to the other. The value is highly dependent on the types of materials making up the two surfaces.

As air resistance, gravity, and rolling friction each contribute to power losses in a system, the approximate power loss in a system may be expressed as:

$$\text{power loss} = VC_d A\left(\frac{\tilde{n}}{2}\right)(V + V_{wind})^2 + mgV(COF + \text{slope})$$

Consequently, the total power output ($P_o$) for a bicycle may be expressed as the input power applied at the pedals ($P_i$) reduced by power loss, which may have the following form:

$$P_o = P_i - \left(VC_dA\left(\frac{\tilde{n}}{2}\right)(V + V_{wind})^2 + mgV(COF + \text{slope})\right)$$

The foregoing equations, or other equations modeling real-world conditions, may be used to simulate the effects of nature, the environment, road conditions, and the like on within exercise system. As will be appreciated in view of the disclosure herein, such equations may utilize values that simulate real-world conditions and/or provide values used to simulate such conditions. Notably, such equations are merely exemplary and other suitable calculations or equations may be used for determining, simulating or modeling real-world forces. FIG. 6 illustrates an example method 300 that may be used to simulate such real-world conditions. It should be appreciated that method 300 is merely exemplary and that the various illustrated steps may be performed in any suitable order, and that some steps may be eliminated or altered in other embodiments. Moreover, the various steps of method 300 may be performed using any suitable components of an exercise system, including components illustrated in FIG. 4. For instance, in one embodiment, method 300 is performed or coordinated by a controller (e.g., controller 102) or other components. In another embodiment, method 300 is performed using other devices or systems, including by using a controller (e.g., controller 102) in combination with one or more sensors (e.g., sensors 106) and/or a resistance mechanism (e.g., resistance mechanism 110). In still another embodiment, a collection of one or more components of an exercise system that performs all or a portion of method 300 may be part of a simulation system that simulates real-world or environmental conditions on an exercise cycle.

In FIG. 6, the method 300 begins 302 and the simulated velocity of the rider is determined in act 304. Determining the simulated velocity of the rider may be performed in any number of different manners. For instance, as noted herein, an exemplary stationary exercise system may not have any actual velocity, but may include an RPM sensor (see FIG. 4) or other suitable measurement or approximation device. An RPM sensor may be used to obtain a rotational speed or angular velocity value of a rotating component such as a crankshaft or flywheel. Based on the circumference of the rotating component, gearing, or other factors, a simulated linear velocity may be obtained. For instance, the sensor may itself calculate a linear velocity, or may provide the rotational speed to a separate component (e.g., controller 102) which can then compute the simulated linear velocity.

As noted herein, in some cases the linear velocity may be geared up or down. By way of illustration, a measurement of the rotational speed of the crankshaft of a bicycle may by itself be insufficient to obtain an accurate approximation of the corresponding linear velocity of a non-stationary bicycle inasmuch as speed may be altered by a gear ratio between the crankshaft and a drive wheel or flywheel. A stationary cycle may also include multiple physical and/or virtual gears that can be selected by the user. As an example, a road bicycle may often have anywhere between one and thirty gears, and a stationary cycle may have a corresponding number of physical or simulated, virtual gears. In either case, as the gear of a bicycle changes, the relationship between linear velocity of the bicycle and the rotational speed of the crankshaft can also change. Accordingly, in some embodiments of the present disclosure, determining the velocity of the rider in act 304 may include a controller or other component determining the velocity based on rotational speed and/or based on one or more gearing ratios or gearing tables. For a stationary exercise cycle, gearing tables are optionally based on averaged or normalized gearing information from non-stationary bicycles.

In the illustrated embodiment, once the simulated velocity has been determined, the method 300 may include a step for determining simulated air resistance (step 306) and a step for determining simulated frictional and/or gravitational resistance (step 308). In FIG. 6, steps 306, 308 are shown as occurring in parallel, although the steps 306, 308—including the acts therein—may be performed in series, or in any suitable order.

The step 306 for determining simulated air resistance optionally includes an act of determining a simulated drag coefficient (act 310). As discussed previously, the drag coefficient may relate to the aerodynamic characteristics of a rider on a corresponding non-stationary bicycle, and for a stationary bicycle may be fixed by a simulation system or may be dynamic. For instance, the simulated drag coefficient may vary from person to person, or may even vary from second-to-second based on factors such as riding position.

In general, the simulated drag coefficient may vary between about 0.3 and about 1.2, although in other embodiments the drag coefficient may be higher or lower. In one embodiment in which the simulated drag coefficient is fixed, the value may be between about 0.7 and about 0.9, although such values are merely examples. In embodiments in which the drag coefficient varies, the variation may occur based on the position of the rider, the physical personal characteristics of the rider, and the like. If a rider is in a hunched, aerodynamic position, the drag coefficient may, for example, be determined to be between about 0.3 and about 0.7. If the rider is upright, the drag coefficient may be between about 0.8 and about 1.2.

Further still, in some embodiments, determining the simulated drag coefficient may include determining or using personal characteristics of the rider. Example personal characteristics may include the height and/or weight of the rider, the type of clothing being worn or simulated, and the like. For instance, the rider may provide height or weight information directly into a control panel (see FIG. 2) of an exercise device, or the information may be obtained from another source (e.g., a remote database such as IFIT.COM, sensors on the equipment, etc). In act 310, the simulated drag coefficient may be higher for a larger person than for a person with a lesser weight or height. Thus, in some embodiments, determining the simulated drag coefficient (act 310) is based on personal characteristics (e.g., height/weight information) and/or riding position.

The step for determining simulated air resistance (step 306) may also include determining a frontal area of a rider (act 312). Determining the frontal area in act 312 may be performed in any number of manners. For instance, frontal area may be assumed to be an approximate value that is fixed value regardless of the riding position or personal characteristics of a user. In such a case, the frontal area may be between about 0.4 meters and about 0.6 meters, although such values are merely examples and the frontal area may be higher or lower. In still other embodiments, frontal area may be approximated in a manner that varies based on factors similar to those optionally considered in determining the drag coefficient. A determination of the frontal area in act 312 may include obtaining an approximation based on any combination of a fixed value, or a user's height, weight, or riding position. Such information may be obtained using sensors, user input, from data stores, using a processor/controller, or in other manners.

In some embodiments of the present disclosure, an exercise system may include one or more controllers or other modules (see FIG. 4) that act as a simulation system for weather or other environmental factors. For instance, surface wind may have a significant effect on a real-world cyclist, but almost none on a user of a stationary cycle, particularly if the stationary cycle is indoors. In the method 300, simulating real-world conditions may include determining a simulated wind velocity (act 314) in the step for determining simulated air resistance (step 306).

Determining simulated wind velocity (act 314) can include evaluating any number of resources to set or determine the relevant wind to be simulated. For instance, in one embodiment an exercise system may include a component that generates a random or pseudo-random wind value and/or direction. In other embodiments, wind may be based on the actual location being simulated. By way of illustration, if a rider is simulating the fourth stage of the Tour de France, a wind simulation system of exercise system may access real-time weather information of the Brittany region of France, may access historical or average values, or may obtain wind information in other manners. In still other embodiments, a user may have full or partial control over wind values. For instance, a user may create a workout and indicate that the simulated wind should satisfy certain criteria (e.g., minimum, maximum, direction, fixed, variable, etc.). The system may then be set to apply the wind based on such criteria and, if appropriate, vary the wind speed in a regular or random nature. The direction of simulated wind may be similarly determined, but may also be based on the direction of travel being simulated for the user. Accordingly, in determining simulated wind velocity, a speed and direction component of the simulated wind may be obtained. The direction component may be an absolute value (e.g., southwest) or may be relative to the simulated direction in which the rider is moving during a workout program (e.g., thirty degrees off parallel to the direction of travel).

Where the simulated wind direction is not directly in a headwind or tailwind direction, the simulated wind is optionally separated into components. The components may be obtained for directions parallel and/or perpendicular to the travel direction. For instance, FIG. 6 illustrates a wind of about 8 miles per hour wind that is at about thirty degrees offset from a direct headwind relative to the ride being simulated. Using standard trigonometric functions, the simulated wind component in a true headwind direction may be about 6.93 miles per hour, while the simulated wind component in a true cross-wind direction may be about 4.00 miles per hour. In some embodiments, determining simulated wind velocity in act 314 may also include displaying wind speed and/or direction to the user on a map (see FIG. 3) or in another manner.

Any number of systems may be utilized to determine speed and/or direction of a simulated wind component, including surface wind. In some embodiments, an exercise device may include a wind simulation system. Such a wind simulation system may be provided in software, hardware, or another component, or in any combination of the foregoing. For instance, in one embodiment, a controller (e.g., controller 102) may be programmed or otherwise equipped to determine a simulated wind direction and/or speed in any manner such as those described herein. In another embodiment, a controller may access or execute software (e.g., stored in memory/storage component 114, or available using communication interface 118) to simulate wind.

Optionally, a rider's simulated altitude may also be determined (act 316). As discussed herein, embodiments of the present disclosure include simulating real-world terrain, or even simulating virtual terrain. To simulate such terrain, the rider's elevation may increase or decrease, respectively, as the rider goes up and down simulated hills. If real-world or other topographical information is used, the rider's virtual speed can be used to track the simulated current location of the rider along a particular route, as well as the simulated current altitude.

The rider's altitude may be used for any number of purposes. For instance, the simulated current altitude may be displayed to a rider on a control panel or similar device to provide visual feedback to the user as to their location and workout. Environmental conditions such as air density also can vary based on altitude. At sea level, the density of air under standard atmospheric conditions is about 1.225 $kg/m^3$. Under the same conditions, but at 1000 meters altitude, the density of air is about 1.088 $kg/m^3$. Air density may also change based on temperature or other weather conditions which may also be factored in. Accordingly, in some embodiments, determining altitude in act 316 may also include determining a simulated air density value. In other embodiments, the simulated air density value may be fixed regardless of altitude. A fixed air density may be between about 1.1 $kg/m^3$ and 1.2 $kg/m^3$, but may be higher or lower in other embodiments. The air density may also be fixed for a particular workout by, for instance, averaging the simulated elevation throughout the entire workout.

The simulated current altitude of the rider may also be used for other purposes. For instance, act 318 includes an optional act of applying a scaling factor based on a simulation that includes surrounding geographic terrain. In real-world conditions, there may be wind that is at least partially blocked or otherwise affected by the surrounding and nearby terrain. For instance, in the bottom of a narrow canyon between two hillsides, a rider that is sufficiently below the peak height may feel almost no wind if the wind direction is such that it is blocked by the hillside. As the user climbs towards the top of the hill, how much of the wind is felt may gradually build until at the top the user feels the full effect of the wind. In similar geography, if the wind is blowing directly into the canyon a funneling effect may occur so as to increase the effect of the wind.

Accordingly, in some embodiments, a scaling factor is applied (act 318) to the determined simulated wind velocity. The scaling factor may be based on the direction of simulated wind and/or the topography of the surrounding terrain being simulated. For instance, if the simulated current location is lower in elevation relative to nearby terrain in the direction the wind originates, the difference in elevation may be determined. Based on the difference, the scaling factor may vary from about 0.0 to about 1.0. By way of illustration, one manner of calculating and applying a scaling factor may include determining that when the difference between the peak altitude and current altitude is greater than 500 meters, the scaling factor is 0.0, indicating no surface wind affects the air resistance on the rider. Where the difference is between 500 meters and 0 meters, the scaling factor may vary linearly. Thus, in the above example, if the peak altitude is 100 meters and a rider is at a simulated current altitude of 750 meters, the scaling factor may be 0.5. If the rider's simulated current altitude is at 1000 meters the scaling factor may be 1.0. Consequently, as the rider ascends a hill, the scaling factor may increase, which in turn causes a backing off of the adjustment to the simulated wind velocity as well as to the adjustment of simulated air resistance due to the surrounding terrain. Of course, other mechanisms or algorithms may be applied to scale the simulated wind or air resistance based on the location, size, topography, altitude, or other conditions of nearby and surrounding terrain.

The step 306 for determining air resistance may further include calculating a simulated air resistance component (act 320). In one embodiment, calculating the simulated air resistance act 320 may include using any one or more of the determined velocity of the rider, drag coefficient, frontal area, wind velocity, altitude, air density, or scaling factor. For instance, using a previously presented formula, and applying a scaling factor (SF) to the surface wind component, the approximate power loss due to air resistance may be calculated as:

$$P_d = VC_dA\left(\frac{\tilde{n}}{2}\right)(V + (SF \times V_{wind}))^2$$

The resultant value for power loss ($P_d$) may be obtained in Watts or another unit. To obtain a value in Watts, the velocity values (V and $V_{wind}$) may be in meters per second, the area (A) in square meters, and the air density (ρ) in $kg/m^3$. The scaling factor (SF) and drag coefficient ($C_d$) may be unitless values. When a scaling factor is not used, the scaling factor may simply be set to 1.0 or simply eliminated. Notably, the value of V may be a simulated linear velocity. As noted previously, the linear velocity may be simulated by using a measured rotational speed, such that the above equation may produce a resultant simulated power loss based in part on rotational speed, although rotational speed is not directly in the above equation. In other embodiments, however, the equation may be modified to reflect the measured rotational speed of a movable exercise element such as a pedal assembly or flywheel.

As noted above, the method 300 may also include a step 308 for determining resistance based on simulated frictional and gravitational forces. In one embodiment, step 308 includes a step for determining slope of terrain being simulated (act 322). The slope can generally represent the rate at which elevation changes, and thus may be determined by dividing the change to simulated elevation over the simulated surface distance.

A mass component may also be determined in act 324. In at least one embodiment, the determined mass includes the mass of the rider. For instance a rider may input his or her weight into a control panel (see FIG. 2). In other embodiments, the weight may be obtained from a secondary source (e.g., the IFIT.COM website, a personal computer or portable electronic device linked to the exercise device, one or more sensors, etc.). The weight may be converted to a mass value, or a mass value may be obtained directly.

In some embodiments, the mass may be a total mass of the rider, although the mass may also include a mass of the exercise device. In one embodiment, the mass of an exercise cycle may be assumed to be a fixed value. For instance, the mass may be fixed as the average mass of a non-stationary cycle. The mass contribution of the exercise cycle may also be variable. For instance, a simulation system may allow a user to select the type of bike being simulated. Different weights may be associated with racing cycles, a triathlon cycles, a mountain bikes, a touring bikes, or any other type of bike. Indeed, a user may even simulate the user's own equipment or some other equipment by specifically selecting a particular bike, mass, or weight for the cycle used in the simulation.

The step 308 for determining simulated frictional and gravitational resistance components may also include an act 326 of determining a simulated coefficient of friction. As noted above, a coefficient of rolling friction may relate to the frictional relationship between a simulated exercise device and the simulated terrain being traversed. In one embodiment of the present disclosure, the coefficient of rolling friction may be fully or partially fixed. For instance, the coefficient of rolling friction may be assumed constant for all users of an exercise system, fixed for all types of terrain, or even fixed for an entire workout by a single user, regardless of changes in terrain, cycle, weather, etc. In other embodiments, however, the simulated coefficient of friction may vary. For instance, depending on a non-stationary bicycle being used, wheels may have increased width. The increased width can increase the surface area in contact with terrain, and thus the coefficient of rolling friction. Inflation levels, temperatures, road types, rain, and other factors can also affect the coefficient of rolling friction. Each such factor may be considered by the simulation system of the present disclosure so as to vary a simulated coefficient of friction based on the type of simulated bicycle, mass of simulated bicycle, tire inflation level, road type, temperature, weather, etc.

For purposes of the present disclosure, the simulated coefficient of rolling friction may vary in any suitable manner. Typical tires for a bicycle may have a coefficient of friction ranging from about 0.004 for high quality tires on a smooth, asphalt surface to about 0.25 for lower quality tires on a sandy surface, although a higher or lower coefficient of rolling friction may also be used. Thus, in some embodiments, determining the simulated coefficient of rolling friction may also include evaluating the terrain being traversed. If the rider is simulating a paved highway, the coefficient of friction may be relatively low; however, if the rider is riding on a dirt road or low quality road or path, the coefficient of friction may be significantly higher. Exemplary values may be stored in a memory or storage component (see FIG. 4) or dynamically calculated based on the terrain, weather, or other conditions being simulated.

The step 308 for determining simulated frictional and/or gravitational resistance components may further include calculating a simulated frictional resistance component (act 328). Such an act may also include calculating gravitational components expected on a real-world user of a non-stationary device. In one embodiment, calculating the simulated frictional and/or gravitational resistance components may include using any one or more of the simulated velocity of the rider, slope, mass, and coefficient of rolling friction. For instance, the following formula, which is also presented above, may be used:

$$P_f = mgV(C_{rf} + \text{slope})$$

The various components may be provided in any suitable units; however, where the mass (m) is in kilograms, the gravitational constant (g) is in $m/s^2$, velocity (V) is in meters per second, and the coefficient of rolling friction ($C_{rf}$) and slope are unitless, the simulated power loss due to friction and gravity ($P_f$) may be returned in Watts.

The simulated air resistance calculated in step 306 and the simulated frictional/gravitational elements calculated in step 308 may be combined in act 330. In one embodiment, frictional, gravitational, and air resistance components are combined to determine a simulated power loss value as described herein. Such power loss may also be used to calculate the resistance to apply to an exercise device (act 332) to simulate real-world conditions.

More particularly, and as discussed previously with respect to FIG. 5, power, rotational speed, and resistance are optionally related to each other by modeling an equation, by using lookup tables, or in any other suitable manner. In one embodiment, once the simulated power and the rotational speed are known, a corresponding resistance can be calculated. Thus, as described above, one embodiment of the present disclosure may include calculating a combined simulated power value using environmental factors such as gravity, friction, and air resistance. When the exercise device is being operated, a rotational speed may also be determined. The two values may, in turn, be input into a modeled equation produced using the method of FIG. 5 or in another manner, including a multi-dimensional lookup table, to obtain a resistance value in act 332. The resistance value may then be applied to the exercise device in act 334.

In accordance with certain embodiments of the present disclosure, an exercise workout or program may iteratively apply aspects of the method 300. For instance, as a user speeds up or down, changes gears, changes simulated elevation, etc., the simulated linear velocity may constantly be monitored, and the effect such velocity has on frictional, gravitational, and air resistance may also be calculated. Thus, in act 336 a determination may be made as to whether a ride, workout, or exercise program has been completed. If the ride has not been completed, an exercise system may repeat any or all of the prior acts or steps, including determining simulated air resistance elements (step 306), determining simulated frictional/gravitational resistance elements (step 308), and using the same to apply a resistance to the exercise device (act 334). When the ride is complete, the process 300 may terminate.

INDUSTRIAL APPLICABILITY

In general, the exercise systems and devices of the present disclosure provide an exercise cycle that allows simulation of real-world environmental factors corresponding to a programmed workout or course. Specifically, as a rider exercises, expected values for air resistance and/or resistance due to frictional or gravitational effects can be calculated. Such effects can be related to a frictional mechanism in the exercise device to give approximately the same resistance as would be felt as if moving along the actual, real-world terrain.

The effects of real-world and environmental factors may also be tailored specifically to the rider. The rider's personal characteristics (e.g., height and weight) can have a direct impact on the real-world effects felt by the rider. That is, air resistance is based on the frontal area of the rider, which frontal area is influenced at least in part by the height and weight of the rider. Similarly, frictional rolling resistance is based on the weight of the rider.

Environmental factors such as wind and topography also affect the difficulty of a ride along an actual terrain, and can be simulated in accordance with embodiments of the present disclosure. Wind—whether random, simulated, or based on real-time or historical data—can also be considered and applied so as to increase how similar a simulated ride is to the actual ride. For instance, wind can be combined with the velocity of the user to determine the actual air resistance that would be felt by a rider in the actual terrain, and that resistance can be applied to the resistance mechanism of a stationary device during a simulation.

Based on wind, an exercise device may include a power assist mechanism to assist the rider's movement in some embodiments. For instance, with a sufficient tailwind, a rider may gain speed even without applying a pedaling force. An exercise device may be linked to GOOGLE MAPS or other databases that allow a user to download or create programs based on actual elevations along a known course or route. Such topographical information may assist in determining locations along a route as well as fictional or air resistance information. For instance, topography of nearby terrain may be used to determine the effect of wind on the cyclist.

In addition, embodiments of the present disclosure provide the ability to have negative or positive angular orientations of the exercise device. With the ability to provide both positive and negative angular positioning of the exercise device, a controller of a simulation system may provide instructions such that the angular position and vertical pitch changes during a workout to more closely correspond to feel of the real-world course, while the resistance mechanism can provide changes to difficultly corresponding to the changes in slope. This will more closely simulate an actual course and will motivate the user to continue their workout.

The particular manner in which real-world conditions are simulated may be varied. Some embodiments may use equations or modeling based on steady conditions. As a result, forces associated with acceleration, braking, turning, and the like may not be considered. More complex simulations may be used to also account for non-steady conditions. Further, although embodiments may determine resistance as based on values such as power and rotational speed, modeling may be performed in other manners, such as by calculating forces or torque values.

Approximation or simulation of real-world conditions may utilize other systems or components of an exercise system. For instance, in one embodiment an exercise cycle includes a seat having an adjustable height. Based on the position of the seat, the height of the user may be approximated, thereby allowing an effective simulation even in the absence of direct access to the user's physical personal characteristic. Additionally, or alternatively, the exercise system may include a sensor usable to detect the user's weight even in the absence of a direct input, access to a database, or the like. In still other embodiments, a user may be able to input information such as the user's clothing size. The clothing size, potentially in combination with other personal characteristics, may be used in simulating air resistance, such as by determining an appropriate frontal area or drag coefficient.

In conclusion, embodiments of the present systems, devices, and methods provide for a stationary exercise cycle which simulates real-world conditions. More specifically, the real-world conditions that would affect the same rider when riding the actual course, are simulated by the stationary exercise cycle so that any of the size, shape, riding style, and the like of the user may specifically be factored in to provide a more realistic riding experience.

What is claimed is:

1. An exercise apparatus, comprising:

a rotatable pedal assembly;

a resistance mechanism disposed to apply a variable resistance to the rotatable pedal assembly; and at least one controller comprising a processor, wherein the at least one controller is in communication with the resistance mechanism to vary resistance applied by the resistance mechanism to the rotatable pedal assembly based at least in part on a simulated air resistance;

a sensor determining a simulated speed of a user of the exercise apparatus; and an input comprising weather information at a real world remote location, the weather information including a speed of the wind at the real world remote location, the processor determining the simulated air resistance based at least in part on the simulated speed of the user of the exercise apparatus and the speed of the wind at the real world remote location, the controller selectively varying the resistance of the resistance mechanism based on the simulated air resistance.

2. The exercise apparatus of claim 1, wherein the simulated air resistance is dependent on at least one physical characteristic of a user of the exercise apparatus, the at least one physical characteristic of the user including a height of the user.

3. The exercise apparatus of claim 1, wherein the simulated air resistance is dependent on at least one physical characteristic of a user of the exercise apparatus, the at least one physical characteristic of the user including an approximate frontal area of the user.

4. The exercise apparatus of claim 1, wherein the exercise apparatus includes a communication interface configured to access a remote source to obtain at least one physical characteristic of the user, the at least one physical characteristic used to determine the simulated air resistance.

5. The exercise apparatus of claim 1, wherein the simulated air resistance is at least in part dependent on a drag coefficient.

6. The exercise apparatus of claim 5, wherein the drag coefficient changes when an aerodynamic position of the user changes.

7. The exercise apparatus of claim 1, wherein the resistance applied by the resistance mechanism to the rotatable pedal assembly is at least in part based on a simulated rolling friction, the simulated rolling friction being at least in part dependent on velocity and slope.

8. The exercise apparatus of claim 1, wherein the simulated air resistance is at least in part dependent on a simulated current altitude relative to an altitude of surrounding terrain.

9. The exercise apparatus of claim 8, wherein the simulated air resistance is based at least in part on a scaling factor applied to simulated wind velocity.

10. The exercise apparatus of claim 8, wherein the simulated air resistance is variable through at least a backing off of an adjustment to the simulated air resistance as the simulated current altitude approaches a peak altitude.

11. The exercise apparatus of claim 1, wherein the simulated air resistance is at least in part dependent on a wind direction at the real world remote location.

12. The exercise apparatus of claim 1, wherein the simulated air resistance includes at least a surface wind at the real world remote location.

13. The exercise apparatus of claim 1, wherein the simulated air resistance is at least in part based on the equation (½)(VCdAp)(V+V wind)2+mgV(Crf+slope).

14. The exercise apparatus of claim 1 further comprising a display for displaying images corresponding to a real-world terrain being simulated.

15. The exercise apparatus of claim 1, wherein the resistance mechanism applies a variable resistance based at least in part on a relation of a physical setting of the resistance mechanism to a power value and a rotational speed.

16. The exercise apparatus of claim 1, wherein the controller selectively varies the resistance of the resistance mechanism based upon the simulated speed of the user of the exercise apparatus, a speed of a wind at the real world remote location, and a direction of the wind at the real world remote location.

17. The exercise apparatus of claim 1, wherein the processor determines a drag based upon the simulated speed of the user of the exercise apparatus and the speed of the wind at the real world remote location; and wherein the processor uses the drag to determine an amount the resistance of the resistance mechanism should vary, the controller varying the resistance of the resistance mechanism by the determined amount.

18. The exercise apparatus of claim 1, further comprising a second sensor to determine a body position of the user of the exercise apparatus, the processor using the simulated speed of the user of the exercise apparatus and the body position of the user of the exercise apparatus to determine an amount the resistance of the resistance mechanism should vary, the controller varying the resistance of the resistance mechanism by the determined amount.

19. An exercise bicycle, comprising:

a pedal assembly including a first foot pedal and a second foot pedal;

a brake element configured to apply resistance to the pedal assembly;

a controller with at least one processor for adjusting the resistance applied by the brake element by simulating at least air resistance based on one or more particular physical characteristics of a user of the exercise bicycle;

a sensor determining a simulated speed of the user of the exercise bicycle; and an input comprising weather information at a real world remote location, the weather information including a speed of the wind at the real world remote location, the processor determining the simulated air resistance based at least in part on the one or more particular physical characteristics of the user of the exercise bicycle, the simulated speed of the user of the exercise bicycle, and the speed of the wind at the real world remote location, the controller selectively varying the resistance applied by the brake element based on the simulated air resistance.

* * * * *